US005961014A

United States Patent [19]

Knerr

[11] Patent Number: 5,961,014

[45] Date of Patent: Oct. 5, 1999

[54] UNIVERSAL BACKPACK HARNESS

[76] Inventor: Ricky L. Knerr, 281 W. Main St., Crooksville, Ohio 43731-0146

[21] Appl. No.: 08/968,409

[22] Filed: Nov. 12, 1997

Related U.S. Application Data

[60] Provisional application No. 60/030,470, Nov. 13, 1996.

[51] Int. Cl.[6] ..... A45F 3/04

[52] U.S. Cl. ..... 224/259; 224/153; 224/160; 224/250; 224/638; 224/917; 224/901.4

[58] Field of Search ..... 224/153, 259, 224/160, 250, 638, 917, 901.4, 901, 901.2, 901.6, 901.8, 904, 270, 649–651, 680, 671, 674; 294/155, 157; 24/306

[56] References Cited

U.S. PATENT DOCUMENTS

| | | | |
|---|---|---|---|
| 2,407,787 | 9/1946 | Kernahan | 224/8 |
| 2,651,441 | 9/1953 | Rau et al. | 224/160 |
| 3,346,154 | 10/1967 | Bishop | 224/5 |
| 4,327,852 | 5/1982 | Gibson | 224/214 |
| 4,925,064 | 5/1990 | Comora | 224/155 |
| 4,972,981 | 11/1990 | Gex | 224/214 |
| 5,190,306 | 3/1993 | Nauman et al. | 224/160 |
| 5,240,157 | 8/1993 | Selhost | 224/215 |
| 5,535,928 | 7/1996 | Herring | 224/250 |
| 5,540,364 | 7/1996 | Krieger et al. | 224/153 |
| 5,692,661 | 12/1997 | Kellerman | 224/648 |

*Primary Examiner*—Henry J. Recla
*Assistant Examiner*—Timothy L. Maust
*Attorney, Agent, or Firm*—Kremblas, Foster, Millard & Pollick

[57] ABSTRACT

A universal backpack harness having two shoulder straps, a backpack support strap attached to each shoulder strap and upper and lower stabilizing straps also attached to each of the shoulder straps. The backpack support strap passes through a loop on the backpack and supports the backpack by means of the backpack loop. An upper and lower stabilizing strap wrap around a vertical backpack member to stabilize and position the backpack on the wearer's body. Alternatively, the stabilizing straps can also pass through additional loops on the backpack. A breast strap keeps the shoulder straps in place. An optional back pad and shoulder pads are used for wearer comfort. A unique backpack design for use with the harness features horizontal and vertical load securing straps and a vertical support strap that forms a loop for receiving the harness horizontal support strap.

23 Claims, 5 Drawing Sheets

UNIVERSAL BACKPACK HARNESS

CROSS REFERENCE TO RELATED APPLICATION

This application claims the benefit of U.S. provisional application 60/030,470 filed on Nov. 13, 1996 all of which is incorporated by reference as if completely written herein.

BACKGROUND

1. Field of the Invention

This invention relates to harnesses and more particularly to harnesses that are used with backpacks.

2. Background

In the past, backpacks have generally been provided with straps that are sewn directly to the backpack. This results in a number of disadvantages. First, when specific devices are carried in different backpack structures, multiple sets of straps are required for each specific backpack. That is, each backpack has its own set of straps. The backpack and straps are formed as an integrated unit. Further, by attaching the straps directly to the backpack, the point of greatest stress is at the point where the straps are sewn to the backpack.

The typical backpack structure is not designed to allow the harness (straps) to be attached to different pouches, bags, and other backpack forms.

Rather, each backpack form has its own separate harness. In addition, by attaching the harness directly to the bag by stitching, considerable stress is placed on the point where the harness is attached to the backpack and as a result, the point of attachment is typically the first to fail.

Accordingly, it is an object of this invention to provide a universal harness that can be interchanged with a variety of interchangeable backpacks.

It is another object of this invention to provide an attaching means for the harness to the backpack that fully supports the backpack load without placing undue stress at the point of attachment.

It is another object of this invention to provide a stabilizing means for stabilizing the backpack on the backpack harness.

It is a further object of this invention to provide a backpack harness that is fully adjustable to meet a wide range of individuals with varying physical stature.

It is yet another object of this invention to provide a backpack pad for absorbing the impact and friction of the backpack harness and the backpack on the wearer's back.

It is another object of the invention to alleviate the cutting action of the backpack shoulder straps especially when the backpack contains a substantial load.

SUMMARY OF THE INVENTION

To meet these objects, the current invention is a universal backpack harness with a first and second shoulder strap and a backpack harness (load) support strap attached to the two shoulder straps for support and carrying the load of interchangeable backpacks. The backpack harness (load) support strap is passed through a support loop that is attached to the backpack structure. An upper stabilizing strap attached to both shoulder straps and a lower stabilizing strap attached to both shoulder straps further position and stabilize interchangeable backpacks on the user's back. The upper stabilizing loop may be wrapped around a vertical member of the backpack structure and fastened back on itself using a suitable fastener such as a Velcro® fastener. Alternatively, the upper stabilizing strap can be passed through a second loop attached to the backpack structure. Finally, a lower stabilizing loop may be wrapped around the vertical member of the backpack and attached to itself using Velcro® fasteners in a fashion similar to the upper stabilizing strap or it can be passed through a third loop formed by a strap that is attached to the backpack structure.

The shoulder strap typically has an adjusting buckle which allows adjustment of the length of the strap to accommodate individuals of various physical stature. A breast strap is also provided to further stabilize and maintain the shoulder straps on the shoulders of the wearer. An optional back pad is attached to the first and second shoulder strap and positioned generally between the user's back and the upper and lower stabilizing strap assemblies and the load support strap assembly.

Shoulder pads may also be provided for user comfort and to ease the cutting action of the shoulder straps especially under heavy backpack load conditions. The shoulder pad consists of two layers of material between which is sandwiched a padding material. A third, loop-forming layer of material is attached at opposite ends to at least one of the layers of material forming the padding material. One or more loops may be used. The shoulder strap is then passed through the loops formed on the shoulder pad.

The foregoing and other advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
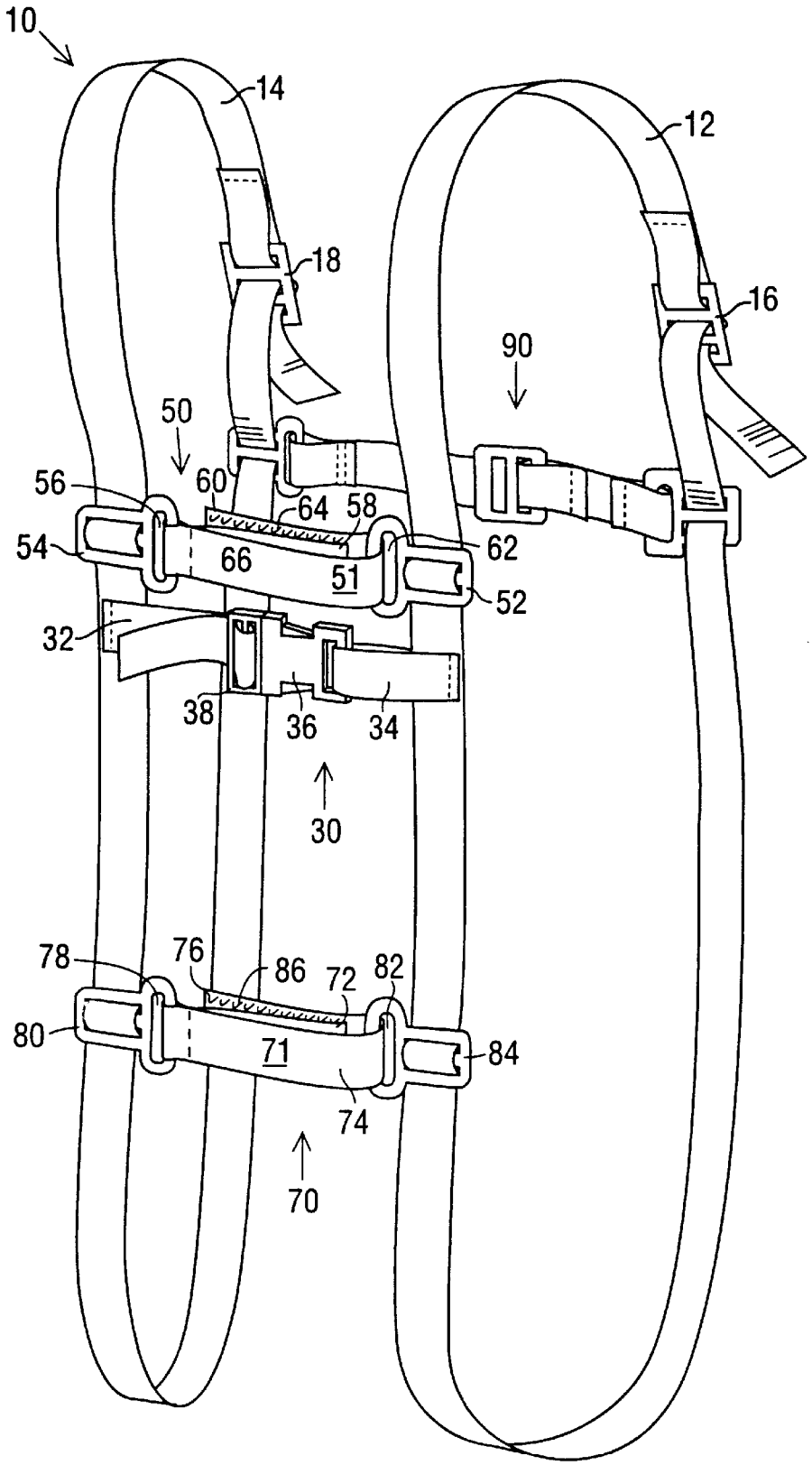
FIG. 1 is a perspective view of the harness strap assembly without an attached backpack.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

As shown in FIG. 1, the harness assembly of this invention is denoted generally by the numeral 10. The harness assembly consists of a first shoulder strap 12 and a second shoulder strap 14. A backpack harness (load) support strap assembly 30 is attached to the first shoulder strap 12 and the second shoulder strap 14. An upper stabilizing strap assembly 50 is attached to the first and second shoulder strap 12 and 14 respectively. A lower stabilizing strap assembly 70 also is attached to the first and second shoulder straps. Typically, the harness assembly also has a breast strap 90 which is also attached to the first and second shoulder straps 12 and 14. Typically, each shoulder strap 12 and 14 has a adjustment buckle 16 and 18, respectively for adjusting the length of each shoulder strap to fit users with a wide variety of physical stature.

Figure 2:
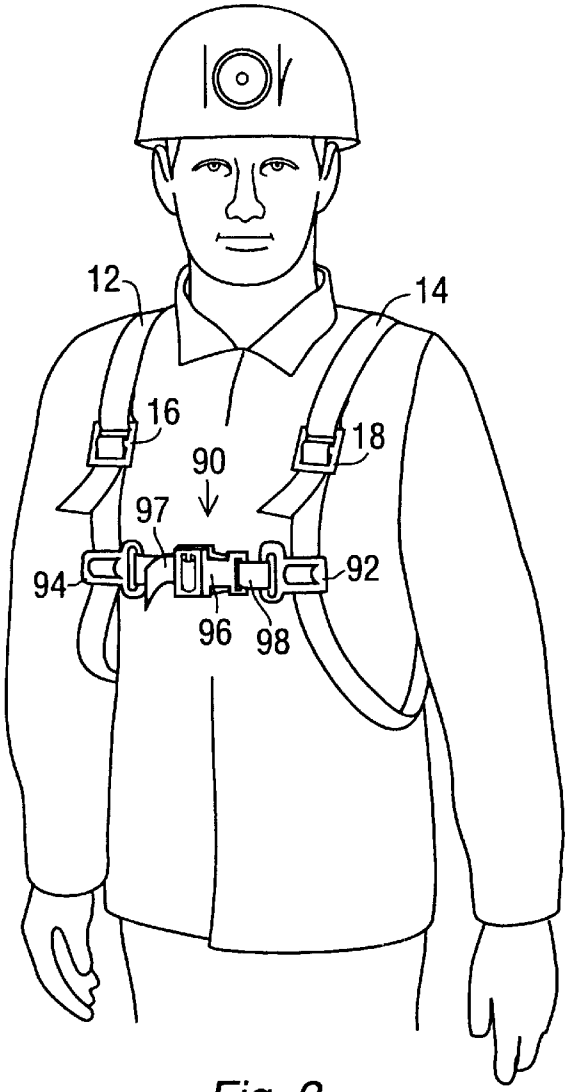
FIG. 2 is a front view of the harness strap assembly as worn by a typical user.

As shown in FIGS. 1 and 2, breast strap assembly 90 attaches to the first and second shoulder straps 12 and 14 to prevent the straps from slipping off of the shoulders of the wearer. As shown in FIGS. 1 and 2, the breast strap assembly 90 can be attached to each shoulder strap with a slidable strap buckle (sternum strap adjuster Slip Lok® buckles; National Molding Corp., Farmingdale, N.Y.) having an elongated slot to which breast straps 97 and 98 are attached. Such strap adjuster buckles are designated by the numerals 92 and 94. The strap adjuster buckles 92 and 94 are fully adjustable up and down on shoulder straps 12 and 14 to provide adjustability for individual wearers.

As illustrated, breast strap assembly 90 consists of two separate strap segments, 97 and 98 that are attached to each other at one end with a suitable buckle 96 such as a jam-lever buckle (National Molding) while the other ends are attached to buckles 92 and 94. It is to be realized that a wide variety of components can be arranged to arrive at the breast strap. For example, a single strap can be sewn to one of the shoulder straps with a tanged buckle attached to the other shoulder strap and a single breast strap with holes engaging the tang used to connect the two. The shoulder strap attachment may be either movable or non-movable along shoulder strap 12 or 14. Movable straps provide more adjustability to meet the various physical stature of different users.

Figure 3:
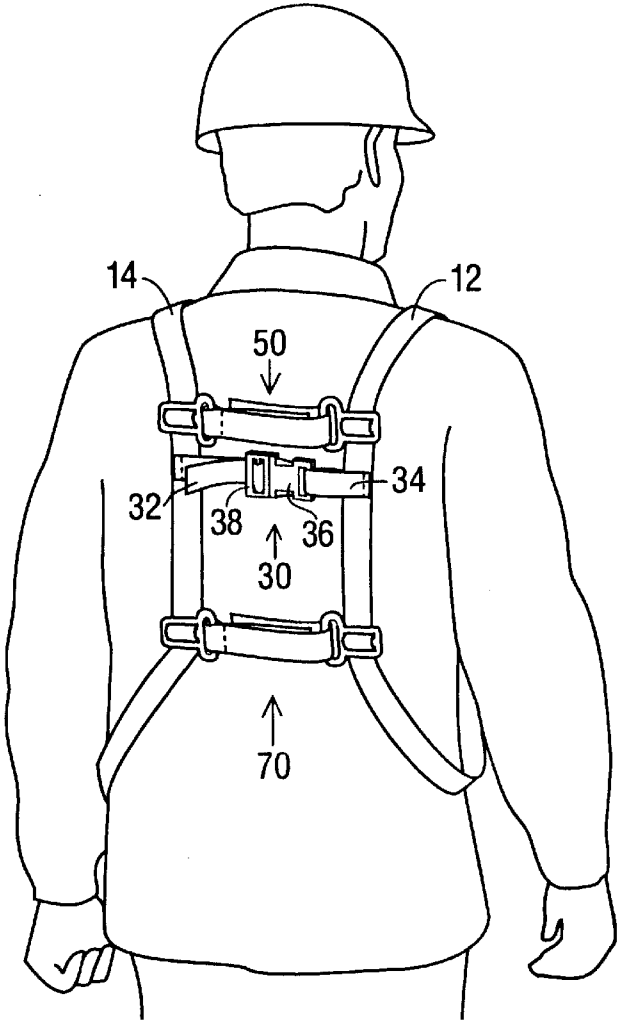
FIG. 3 is a rear view of the harness assembly as worn by a typical user but without an attached backpack.

FIGS. 1 and 3 illustrate the supporting strap assembly 30, the upper stabilizing strap assembly 50, and the lower stabilizing strap assembly 70. Supporting strap assembly 30 can be formed from a wide variety of components, buckles and other attaching and securing devices. As shown, supporting strap assembly 30 consists of two strap members 32 and 34 that are attached directly to the shoulder strap 14 and 12, respectively, that is, the first ends of these supporting straps 32 and 34 have been sewn to the shoulder strap with it being realized that other methods of attachment such as rivets, adhesives, buckles and combinations of them could be used. The other ends of supporting straps 32 and 34 are attached to a female receiving buckle section 36 and a male locking buckle section 38. As shown, the buckle assembly is a side release buckle (Mojave® side squeeze buckle; National Molding) but it is to be realized that a wide variety of other combinations of buckles, straps and fasteners can be used. As shown, the second ends of straps 32 and 34 are inserted into vertical slots on buckle sections 36 and 38 and sewn back on themselves.

Figure 5:
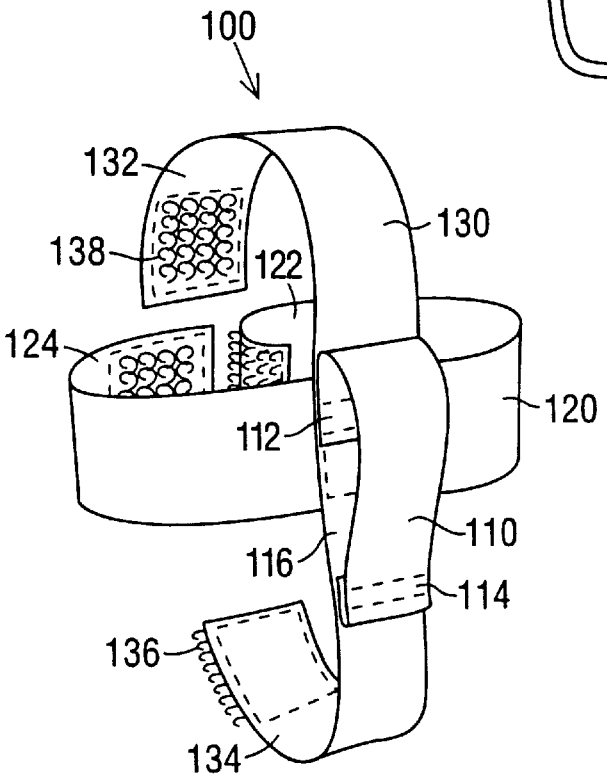
FIG. 5 is a perspective view that illustrates a backpack assembly with associated straps and support loops for attachment to the harness assembly.

FIG. 5 shows a type of backpack 100 suitable for carrying a container, respirator, or similar unitary load. The backpack 100 consists of a vertical backpack strap 130 and a horizontal backpack strap 120. The vertical strap 130 surrounds the top, bottom, front and back of the carried object and is joined at its ends 132 and 134 by Velcro® hooks 136 and Velcro® loops 138. Horizontal strap 120 encloses the front, back, and two sides of the carried object, and, as shown, is crossed by the vertical member 130 at the front and back of the carried object. A center portion of the vertical member 130 crosses the center portion of the horizontal strap 120 and is attached to the center portion of the vertical strap in the area of crossing typically by sewing or other means of attachment. Vertical backpack strap 130 has further attached to it a backpack support strap 110. One end 112 of the support strap 110 is attached to the vertical strap 130 and then doubled back on itself and sewn at its other end 114 to form a backpack support loop with vertical member 130 with opening 116. Support strap 30 assembly is inserted through opening 116 with the backpack load being supported on it in the upper area of strap 110 where it doubles back on itself. By doubling support loop 110 back on itself at end 112, the load is supported on the fabric of support loop 110 thereby eliminating the stress on the stitching when the shoulder straps are sewn directly to the backpack.

As shown in FIGS. 1 and 3, the upper stabilizing strap assembly 50 consists of buckle 52 which adjustably slides on shoulder strap 12 and buckle 54 which adjustably slides on shoulder strap 14, both buckles being made by National Molding Corporation (sternum strap adjuster Slip Lok® buckle). Vertical openings in adjustable buckles 52 and 54 are used to attach strap 51. Strap 51 is passed through vertical opening 56 of buckle 54 and doubled back and sewn on itself near vertical opening 56 so that Velcro® hooks on end 58 project outward. The other end 60 of the stabilizing strap 51 is inserted through vertical slot 62 of adjustable buckle 52 and secured to end 58 with Velcro® loops 68 contacting Velcro® hooks 64 with the assembly of miniature hooks and loops being referred to here as an adjustable hook and loop fastener.

Figure 4:
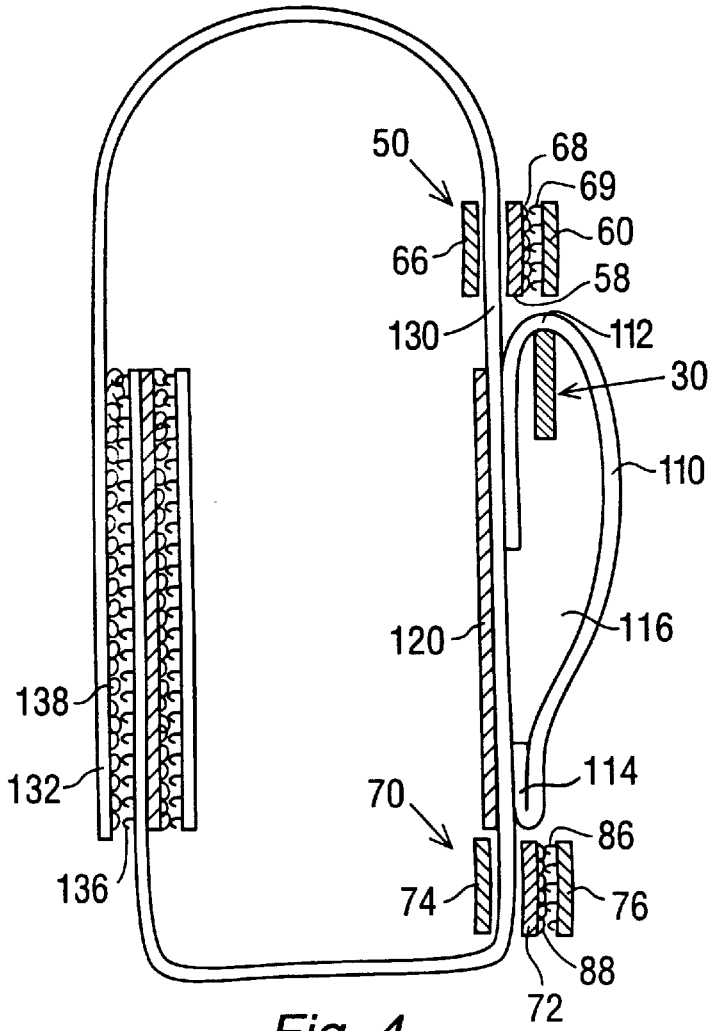
FIG. 4 is a cross-sectional view of a backpack and harness illustrating the position of the harness support strap, the upper stabilizing strap, and the lower stabilizer strap in relation to the backpack.

As shown in FIG. 4, the center portion 66 of the upper stabilizing loop is adjacent to one side of vertical member 130 while the first end 58 with Velcro® loops 68 is adjacent to and on the other side of vertical member 130. End 60 of upper stabilizing strap 51 passes through vertical opening 62 and is secured to the Velcro® loops 68 on the first end of strap 51 by means of Velcro® hooks 69.

Similarly, lower stabilizing strap assembly 70 can be formed from a strap 71 with a first end 72, a middle portion 74 and a second end 76. First end 72 is passed through vertical opening 78 of adjustable shoulder strap buckle 80 and is sewn on itself to form an interlocking loop with vertical opening 78. The opposite end 76 of strap 51 is passed through vertical opening 82 of shoulder strap buckle 84 and is secured to the first end 72 by means of Velcro® hooks 86 on first end 76 and Velcro® loops 88 on end 72 of lower stabilizing strap 71.

As shown in FIG. 4 the middle section 74 of lower stabilizing strap 71 is adjusted to the inside surface of vertical strap 130 while the first end portion 72 is adjusted to the outside surface of vertical strap 130 while the second end 76 of lower stabilizing strap 70 is affixed to the middle section 72 by means of Velcro® hooks 86 attached to second end portion 76 and Velcro® hooks 88 attached to the first end portion 72.

It is to be realized that a wide variety of attaching means can be used for attaching the supporting strap assembly 30, the upper stabilizing strap assembly 50 and the lower stabilizing strap assembly 70 to the shoulder harness strap 12 and 14.

A wide variety of attaching straps and hardware can be employed to form attach supporting strap assembly 30, upper stabilizing strap assembly 50 and lower stabilizing strap assembly 70 to the backpack structure.

As has been illustrated in FIG. 4, the load supporting strap assembly 30 supports the load by means of an inverted U-shaped loop formed by attaching end portion 112 to strap 110 in a doubled back fashion to vertical member 130.

The upper supporting strap assembly 50 and lower supporting strap assembly 70 can also be attached to the backpack structure 100 by a similar loop configuration. Such a three loop configuration on the backpack would be especially suitable when the backpack itself is a container-type structure rather than the vertical strap 130 and horizontal strap 120 construction shown in FIG. 5.

Figure 6:
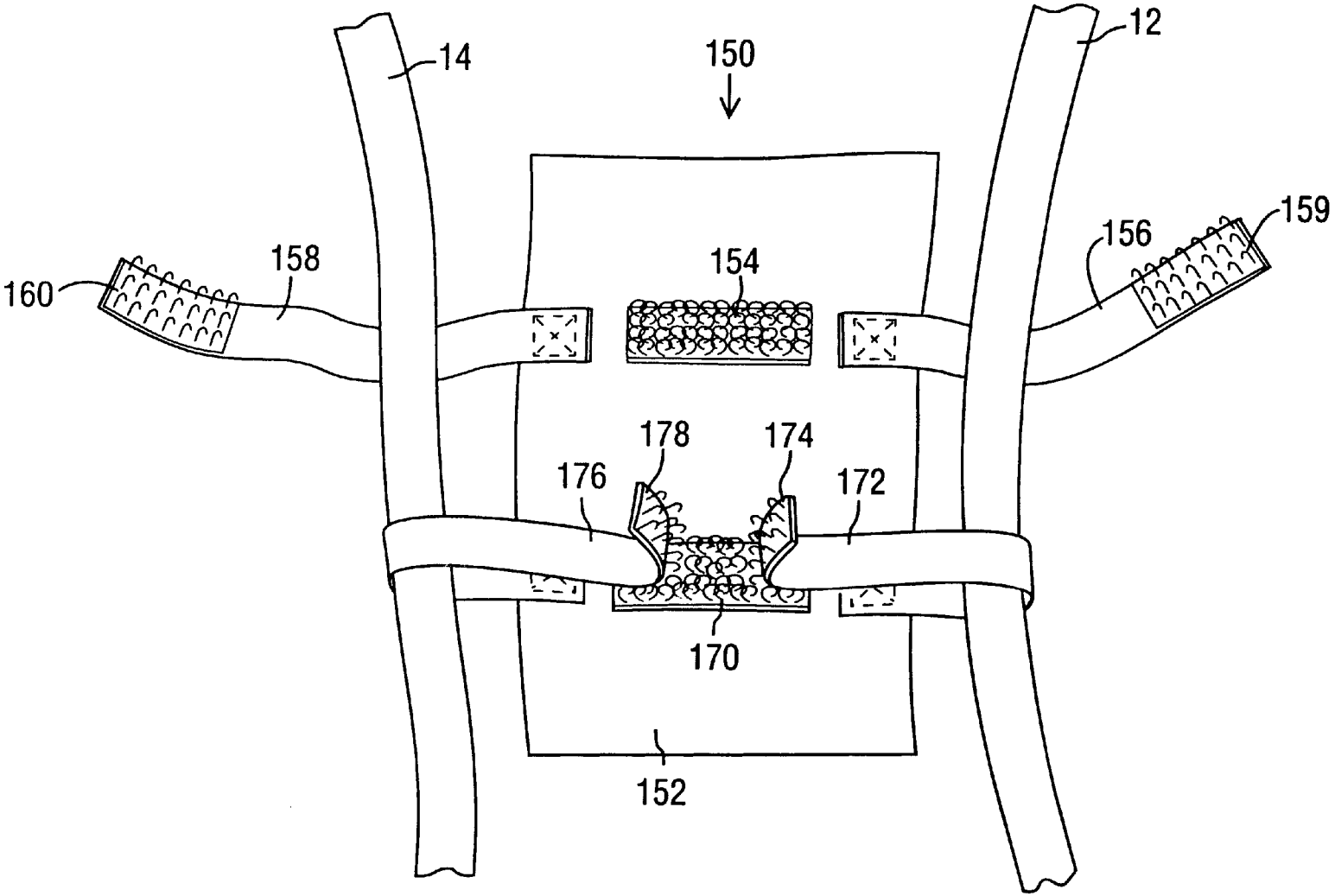
FIG. 6 is a rear view of an optional pad or pillow that is used between the back of the wearer and the back portion of the harness.

An optional pad assembly 150 is shown in FIG. 6 and is situated between the wearer's back and the upper support strap assembly 30, the upper stabilizing assembly 50, and the lower stabilizing strap assembly 70 (FIG. 3). The assembly comprises a pad 152 made from a foamed resilient material or other suitable padding material and can be covered with a fabric, plastic, leather or other suitable covering material. A first Velcro® loop strip 154 is attached to pad 152 in the upper center portion. An upper strap 158 is attached at its first end to pad 152 near the first (left) pad edge. The other end of strap 158 has an attached Velcro® hook strip 160. Strap 158 is looped behind and then over shoulder strap 14 to form a loop after which the Velcro® hooks 160 are fastened to a portion of Velcro® loops 154. Similarly, upper strap 156 is attached at its first end to pad 152 near the opposite (right) pad edge and looped around shoulder strap 12 with Velcro® hooks 159 attaching to a portion of Velcro® loops 154.

A lower set of straps is attached in a similar fashion to pad 152. That is, a Velcro® loop strip 170 is attached to the lower center portion of pad 152. Lower straps 176 are attached to left lower edge portion of pad 152, looped about strap 14, with the Velcro® hooks 178 then attached to a portion of Velcro® loop strip 176. Similarly, the first end of strap 172 is attached near the lower right edge portion of pad 152, looped around strap 12, and the second end with Velcro® hooks 174 attached to a portion of Velcro® loops 170. A wide variety of straps, buckles, snaps, adhesives and other attachment means may be used to attach pad 152 to shoulder straps 12 and 14. Typically straps 156 and 158 are looped around shoulder straps 12 and 14 above upper stabilizing strap assembly 50 as to position the pad between the wearers back and strap assemblies 30, 50, and 70 and to prevent it from slipping down on the wearer's back. Of course, other means and positions of attachment of the back pad will be apparent to those skilled in the art and are within the scope of this invention.

Figure 7:
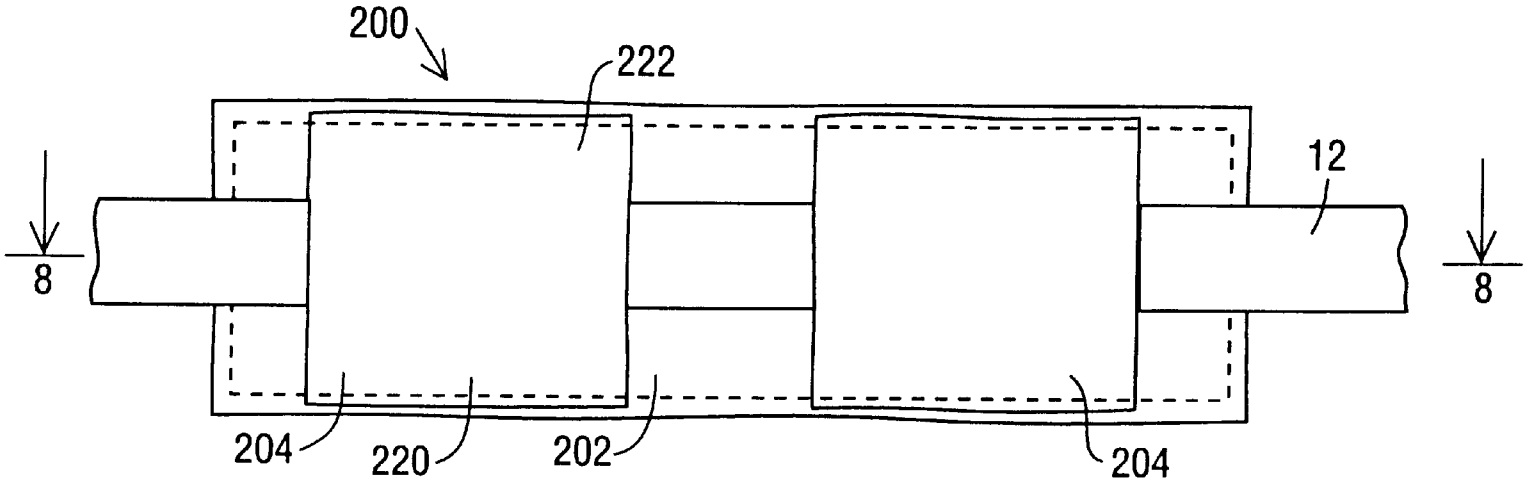
FIG. 7 is a top view of a shoulder pad with only a portion of the shoulder strap shown.
Figure 8:
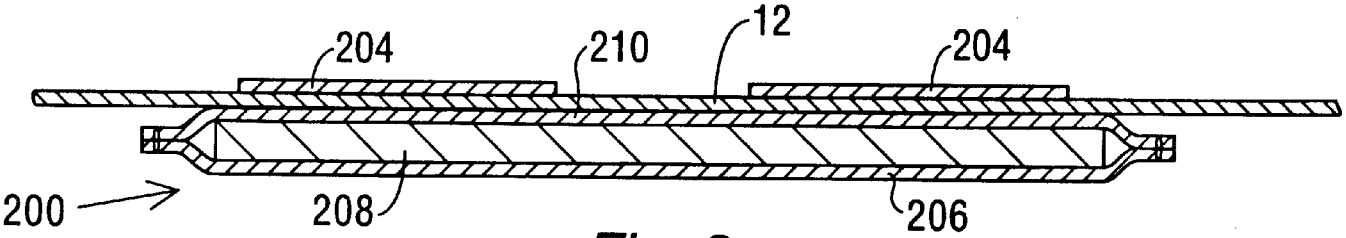
FIG. 8 is a cross-sectional view of the shoulder pad taken along 8—8 in FIG. 7.

FIGS. 7 and 8 illustrate a shoulder pad 200 for use with this invention. As seen in FIG. 8, the shoulder pad 200 consists of a first or lower layer of material, typically fabric 206, padding material 208, and a second or upper layer of material 210, again typically a fabric. The lower and upper layers of material 206 and 210 enclose the padding material 208 with closure being achieved by attaching the edges of lower material 206 and upper material 210 to each other typically by sewing or use of a suitable adhesive. Third strips of material 204 are attached to the upper layer of material at two opposite ends 220 and 222 to form a loop with the loop receiving one of the shoulder straps 12 or 14 (strap 12 shown in FIGS. 7 and 8).

It is possible that changes in configurations to other than those shown could be used but that which is shown is preferred and typical. Without departing from the spirit of this invention, various means of fastening the components together may be used.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

I claim:

1. A backpack harness and backpack with a) said backpack harness comprising:
   1) a first shoulder strap;
   2) a second shoulder strap; and
   3) a substantially horizontal backpack harness support strap attached to said first shoulder strap and said second shoulder strap; and b) said backpack comprising:
   1) a vertical backpack strap with a center portion, a first end portion and a second end portion;
   2) a horizontal backpack strap with a center portion, a first end portion and a second end portion;
   3) said center portion of said horizontal backpack strap crossing said center portion of said vertical backpack strap and at least a portion thereof attached thereto;
   4) said first end portion and said second end portion of said vertical backpack strap attached to each other with a fastener;
   5) said first end portion and said second end portion of said horizontal backpack strap attached to each other with a fastener;
   6) a vertical backpack support strap with a first end and a second end with said first end of said backpack support strap attached to said vertical backpack strap and said second end of said backpack support strap attached to said vertical backpack strap to form a backpack support loop; and
   7) said backpack support loop receiving said horizontal backpack harness support strap and being supported thereon.

2. The backpack harness of claim 1 wherein said backpack support strap comprises a first support member attached to said first shoulder strap, a second support member attached to said second support strap, and a fastening means for connecting said first support member and said second support member.

3. The backpack harness of claim 1 further comprising a back pad assembly affixed to said first and second shoulder straps.

4. The backpack harness of claim 1 further having shoulder pads with each shoulder pad comprising:

a) a first layer of material;

b) a second layer of material;

c) a padding material enclosed within said first layer of material and said second layer of material;

d) a third layer of material attached to said first layer of material to form a loop with said loop receiving one of said first shoulder strap and said second shoulder strap.

5. The backpack harness according to claim 1 with:

a) said first shoulder strap having a first end and a second end;

b) said second shoulder strap having a first end and a second end;

c) means for joining said first end and said second end of said first shoulder strap; and d) means for joining said first end and said second end of said second shoulder strap.

6. The backpack harness according to claim 5 wherein said means for joining said first end and said second end of said first shoulder strap is a first buckle and said means for joining said first end and said second end of said second shoulder strap is a second buckle.

7. The backpack harness of claim 1 further comprising an upper backpack stabilizing strap attached to said first shoulder strap and said second shoulder strap above said substantially horizontal backpack support strap.

8. The backpack harness of claim 7 with said upper backpack stabilizing strap attached to said first shoulder strap with a first buckle slidable on said first shoulder strap and a second buckle slidable on said second shoulder strap.

9. The backpack harness of claim 8 with said upper backpack stabilizing strap comprising adjustable securing means.

10. The backpack harness of claim 9 with said adjustable securing means being a hook and loop fastener.

11. The backpack harness of claim 1 further comprising a lower backpack stabilizing strap attached to said first shoulder strap and said second shoulder strap below said substantially horizontal backpack support strap.

12. The backpack harness of claim 11 with said lower backpack stabilizing strap attached to said first shoulder strap with a first buckle slidable on said first shoulder strap and a second buckle slidable on said second shoulder strap.

13. The backpack harness of claim 12 with said lower backpack stabilizing strap comprising adjustable securing means.

14. The backpack harness of claim 13 with said adjustable securing means being a hook and loop fastener.

15. The backpack harness of claim 1 further comprising a breast strap attached to said first shoulder strap and said second shoulder strap.

16. The backpack harness of claim 15 with said breast strap attached to said first shoulder strap with a first buckle slidable on said first shoulder strap and a second buckle slidable on said second shoulder strap.

17. The backpack harness of claim 16 with said breast strap comprising a first strap segment with a first end and a second end and a second strap segment with a first and second end with the first end of the first strap segment and said first end of said second strap segment joined to each other with a fastener and said second end of said first strap segment joined to said first buckle and said second end of said second strap segment joined to said second buckle.

18. The backpack harness of claim 1 further comprising an upper backpack stabilizing strap attached to said first shoulder strap and said second shoulder strap above said substantially horizontal backpack support strap said upper backpack stabilizing strap having a center portion and a first end portion and a second end portion with said center portion passing on a first side of said vertical backpack strap and said first end portion and said second end portion passing on a second opposite side of said vertical backpack strap and joined to each other with a fastener.

19. The backpack harness of claim 18 with said fastener joining said first end portion and said second end portion of said upper backpack stabilizer strap comprising miniature hooks on said first end portion and miniature loops on said second end portion of said upper backpack stabilizer strap.

20. The backpack harness of claim 1 further comprising a lower backpack stabilizing strap attached to said first shoulder strap and said second shoulder strap below said substantially horizontal backpack support strap said lower backpack stabilizing strap having a center portion and a first end portion and a second end portion with said center portion passing on a first side of said vertical backpack strap and said first end portion and said second end portion passing on a second opposite side of said vertical backpack strap and joined with a fastener.

21. The backpack harness of claim 20 with said fastener joining said first end portion and said second end portion of said lower backpack stabilizer strap comprising miniature hooks on said first end portion and miniature loops on said second end portion.

22. An interchangeable backpack comprising:

a) a vertical backpack strap with a center portion, a first end portion and a second end portion;

b) a horizontal backpack strap with a center portion, a first end portion and a second end portion;

c) said center portion of said horizontal backpack strap crossing said center portion of said vertical backpack strap and at least a portion thereof attached thereto;

d) a first fastener for fastening said first end portion and said second end portion of said vertical backpack strap to each other;

e) a second fastener for fastening said first end portion and said second end portion of said horizontal backpack strap to each other;

f) a vertical backpack support strap with a first end portion and a second end portion with said first end of said backpack support strap attached to said vertical backpack strap and said second end of said backpack support strap attached to said vertical backpack strap to form a backpack support loop;

g) said first end portion of said vertical backpack support strap attached to said vertical backpack strap with the end of said first end portion extending downward with remainder of said vertical backpack support strap doubled back and extending downward with said second end portion of said vertical backpack support strap attached to said vertical backpack strap at a position below said attachment of said first end portion of said vertical backpack support strap; and h) said backpack support loop receiving a horizontal backpack harness support strap and being supported thereon.

23. A backpack harness and an interchangeable backpack, a) said backpack harness comprising:

1) a first shoulder strap;

2) a second shoulder strap;

3) a substantially horizontal backpack harness support strap attached to said first shoulder strap and said second shoulder strap;

4) an upper backpack stabilizing strap attached to said first shoulder strap and said second shoulder strap above said substantially horizontal backpack support strap; and 5) a lower backpack stabilizing strap attached to said first shoulder strap and said second shoulder strap below said substantially horizontal backpack support strap; and b) said interchangeable backpack comprising:

1) a vertical load-securing backpack strap with a center portion, a first end portion and a second end portion;

2) a horizontal load-securing backpack strap with a center portion, a first end portion and a second end portion;

3) said center portion of said horizontal backpack strap crossing said center portion of said vertical backpack strap and at least a portion thereof attached thereto;

4) a first fastener for fastening said first end portion and said second end portion of said vertical backpack strap to each other;

5) a second fastener for fastening said first end portion and said second end portion of said horizontal backpack strap to each other;

6) a vertical backpack support strap with a first end portion and a second end portion with said first end of said backpack support strap attached to said vertical backpack strap and said second end of said backpack support strap attached to said vertical backpack strap to form a backpack support loop; and 7) said backpack support loop receiving said horizontal backpack harness support strap and being supported thereon.

* * * * *